US005406356A

United States Patent [19]

Campbell et al.

[11] Patent Number: 5,406,356

[45] Date of Patent: Apr. 11, 1995

[54] LIQUID TONER IMAGING WITH CONTACT CHARGING

[75] Inventors: Alan S. Campbell; Curt J. Claflin; Randy L. Fagerquist; Tracy G. Floyd, all of Lexington; Brenda M. Kelly, Versailles; Ronald L. Roe; Eric L. Ziercher, both of Lexington, all of Ky.

[73] Assignee: Lexmark International, Inc., Greenwich, Conn.

[21] Appl. No.: 104,463

[22] Filed: Aug. 9, 1993

[51] Int. Cl.[6] ..... G03G 15/02

[52] U.S. Cl. ..... 355/219; 355/256

[58] Field of Search ..... 355/256, 219, 210; 118/661, 659, 660; 361/221

[56] References Cited

U.S. PATENT DOCUMENTS 3,569,803 3/1971 Sato et al. ..... 355/219 X
5,017,965 5/1991 Hashimoto et al. ..... 355/219
5,121,164 6/1992 Landa et al. ..... 355/246
5,291,255 3/1994 Britto et al. ..... 355/285
5,300,989 4/1994 Shakib ..... 355/256

FOREIGN PATENT DOCUMENTS 3-272872 12/1991 Japan .

*Primary Examiner*—A. T. Grimley
*Assistant Examiner*—Nestor R. Ramirez
*Attorney, Agent, or Firm*—John A. Brady

[57] ABSTRACT

An electrophotographic device (1) in which a photoconductor drum (3) is charged by a charging roller (5). Insulating liquid (19, 30) is applied at their initial nip. The charging roller both charges and squeegees largely dry the photoconductor member. The liquid (19) may be produced by incomplete cleaning by a cleaning blade (21). Excess liquid is collected at the sides.

This results in reduction in foreign gasses, and reduction in the operating potential between photoconductor drum and charging roller.

12 Claims, 3 Drawing Sheets

LIQUID TONER IMAGING WITH CONTACT CHARGING

TECHNICAL FIELD

This invention relates to electrostatic imaging apparatus having contact charging of the photoconductor and development on the photoconductor by liquid toner. Contact charging minimizes adding foreign gases to the surrounding air, and liquid development permits development with fine particles employing a wide range of dyes and pigments.

BACKGROUND OF THE INVENTION

Both contact charging and liquid development are known technologies. Two related applications assigned to the assignee or this invention and both filed the same day as follows: U.S. Pat. No. 5,291,255 to Britto et al; and U.S. Pat. No. 5,300,989 to Shakib, filed Sep. 15, 1992, disclose liquid toner imaging of the kind to which this application is directed with charging disclosed as by a "charge roller." Otherwise, no implementation of the two technologies together is known. U.S. Pat. No. 5,017,965 to Hashimoto et al is illustrative of contact charging. U.S. Pat. No. 5,121,164 to Landa et al is illustrative of liquid development.

DISCLOSURE OF THE INVENTION

In a liquid toning imaging system having contact charging by an endless member such as a roller, an insulating liquid is supplied at the initial nip of the photoconductor and the endless member. The charging member is applied with sufficient force to squeegee the photoconductor largely dry as it passes the charging member.

This results in elimination of discharge prior to contact, with corresponding elimination of foreign gases. This further results in a reduction of the operating potential between the photoconductor and the charging member.

BRIEF DESCRIPTION OF THE DRAWING

The details of this invention will be described in connection with accompanying drawings, in which.

BEST MODE FOR CARRYING OUT THE INVENTION

Figure 1:
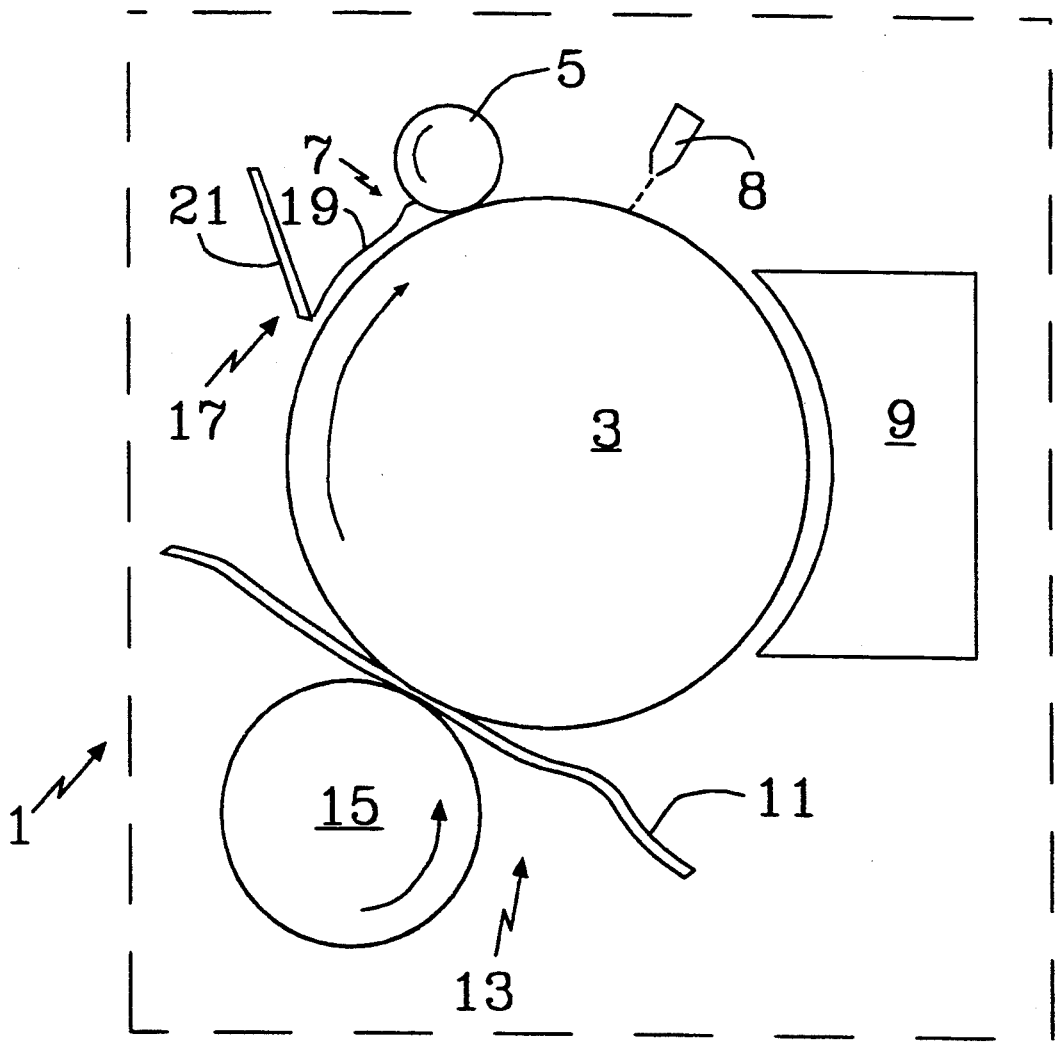
FIG. 1 is an illustrative side view of an embodiment in which incomplete cleaning provides dielectric fluid to the pre-nip region.
Figure 2:
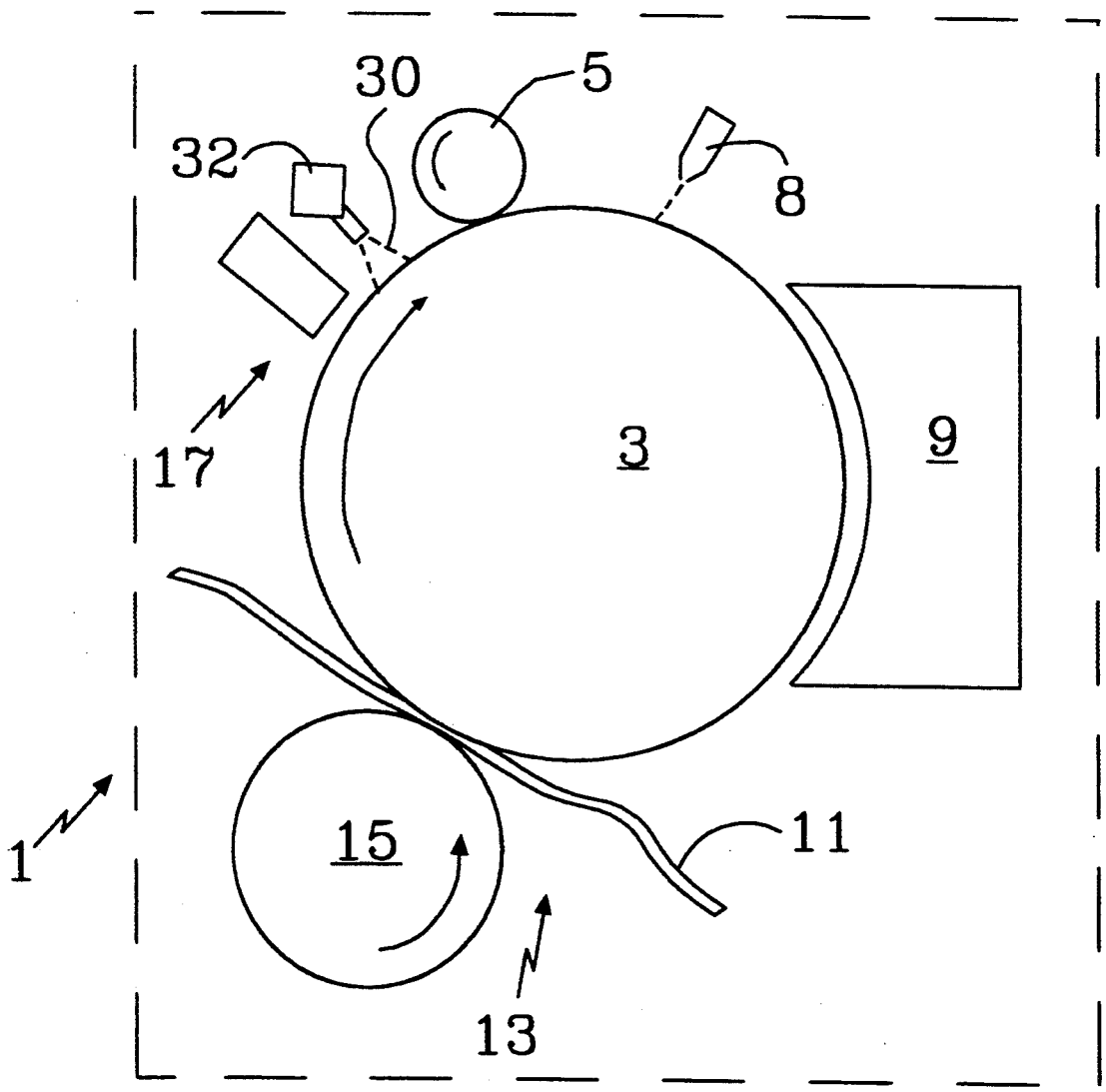
FIG. 2 is a similar illustrative view of an embodiment in which a dedicated fluid source provides dielectric fluid to the pre-nip region.

FIGS. 1 and 2 indicate what may be an essentially conventional, electrostatic printer 1 (largely show illustratively) having a rotating photoconductive roller 3 and a charge roller 5 to charge the roller 3. Charge roller 5 is in contact with and rotates in the same direction as photoconductor roller 3 to form a nip 7 where said roller 5 and roller 3 come into contact. Charge roller 5 replaces the common corona charging. This invention employs an amount of insulative fluid occupying the nip 7 region.

After charging by roller 5 and imaging from a light source 8, such as a laser beam, photoconductor roller 3 rotates to a developer station 9, at which liquid toner is applied. The developed imaging is then transferred to paper 11 or other final substrate or, alternatively, to an intermediate medium (not shown in FIGS. 1 and 2) at transfer station 13 having a transfer roller 15. Then the residual materials on photoconductor are normally cleaning by squeezing or scraping at a cleaning station 17. The imaging on the final substrate is hardened or fixed, typically with heat and some pressure, in a system which may be entirely conventional and therefore is not shown.

For this invention, the dielectric fluid 19 is provided to nip 7. The specific fluid may be any fluid having an insulating property relative to atmospheric air. Liquid toners often employ mineral oil or petroleum fractions, for example, fractions near kerosene, as the vehicle of such toners. Such materials are entirely suitable for this invention as they are sufficiently insulative to eliminate discharge at nip 7.

The embodiment of FIG. 1 employs the liquid toner itself as the fluid provided to nip 7. The cleaning station 17 of FIG. 1 is implemented by a blade 21 lightly contacting the photoconductor drum 3. That spacing allows an amount of fluid 19 to pass the blade 21 and accumulate at nip 7. Charge roller 5 contacts photoconductor 3 with sufficient force to block transmission of fluid 19 past the nip of roller 5 and roller 3, which is a conventional squeegee mechanism.

In the FIG. 2 embodiment, the cleaning station 17 may be conventional and completely clean photoconductor 3. Insulative fluid, 30, is applied as a light spray by applicator 32 which preferably is the same or closely similar to the vehicle of the liquid toner applied at the developer station 9. As in the first embodiment, charging member 5 acts as a squeegee to prevent fluid 30 from passing member 5.

When an amount of such a dielectric fluid 19, 30 is allowed to occupy a portion of the pre-nip region between the charge roller 5 and photoconductor roller 3 during the charging phase of an electrophotographic process, the charge deposited on the photoconductor 3, and therefore, the photoconductor voltage, is increased. This amounts to an enhanced charging efficiency.

The physics of this charge enhancement is not thoroughly understood. Laboratory experiments have clearly shown that increased photoconductor charging exists when the pre-nip of the charge roller is filled with a liquid which has a higher dielectric strength than that which occupies the post-nip. Since the carrier fluid of a typical liquid toner is a dielectric, the fluid can be chosen to have a dielectric strength greater than that of air.

The minimum amount of fluid in the pre-nip required to produce the greatest enhancement to the charging efficiency appears to be that which is necessary to occupy the region of the pre-nip where, without the fluid, dielectric breakdown of the air would take place. This region is determined by the specific geometry of the charge roller and photoconductor, and the magnitude of the potential that exists between them. For typical charge rollers and photoconductor drums, this is the region in the pre-nip between the point where charge roll and photoconductor are just in contact, out to where the surface of the charge roller is on the order of 100 to 200 microns from the photoconductor surface.

Photoconductor charging with a dielectric fluid in the pre-nip for a given charge roll voltage also, conversely, allows a reduction of the charge roll voltage in order to produce a given photoconductor voltage. The charging enhancement effect is independent of the charge roll composition or construction, within the limits which already exist and are known for electrical resistivity, durometer, surface roughness, etc. For example, charging enhancement does not depend on whether the charge roll is constructed from a single component or has one or more layers or coatings. The enhanced charging exists using charge rolls with the following construction:

1) uncoated epichlorohydrin rubber.
2) epichlorohydrin rubber with a single layer of polyamide coating.
3) epichlorohydrin rubber with a single layer of an epoxy cross-linked polyamide.

In order to be of practical value, the charge roll mechanical, electrical and chemical properties should not be significantly affected by constant exposure to the toner carrier liquid. An epichlorohydrin rubber charge roller can be formulated with this in mind.

The existence of enhanced charging efficiency with a dielectric fluid in the pre-charge nip of a charge roller used for photoconductor charging in a liquid toner electrophotographic system also relaxes the requirement for cleaning of the photoconductor before charging; the photoconductor surface need not be made completely fluid-free before engaging the charge roll. In fact, in the FIG. 1 embodiment, the small layer, or coating of dielectric fluid which is present on the photoconductor after the liquid development process provides a mechanism for loading of the pre-nip with the dielectric carrier fluid.

Other factors, such as the viscosity and surface energy of the fluid, geometry of the photoconductor-charge roll nip, and photoconductor process speed are considered to insure proper fluid filling of the pre-nip.

The actual mechanism which places the fluid in the pre-nip is not important to the enhanced charging process. Any device which can be made to deliver the proper amount of the dielectric fluid to the pre-nip can be employed. This makes it possible to use the enhanced charging scheme with flat or continuous roll photoconductors. The dielectric fluid can be flowed onto the photoconductor surface before it enters the charge roll nip, or a jet of this fluid can be trained into the nip.

Figure 3:
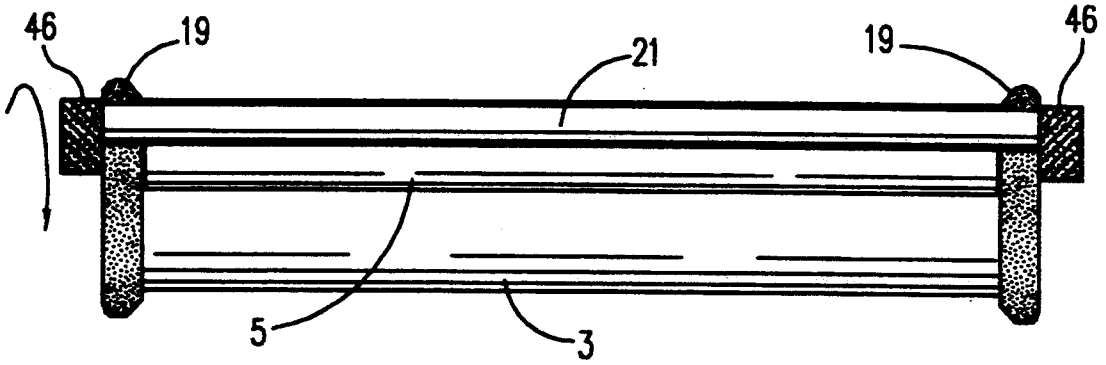
FIG. 3 is a front view illustrative of excess fluid collection.

The insulative fluids 19, 30 may accumulate near nip 7 and then are removed to prevent their reaching sensitive parts of the printer 1. FIG. 3 is a front view of preferred system in accordance with this invention having such collection. Elements essentially identical with those of the FIG. 1 illustration are given the same number. Charge roller 5 does not extend to the ends of photoconductive drum 3, leaving end areas where excess liquid 19 accumulates. Charge roller 5 is shorter than the photoconductive drum 3 by several millimeters on each end.

Figure 4:
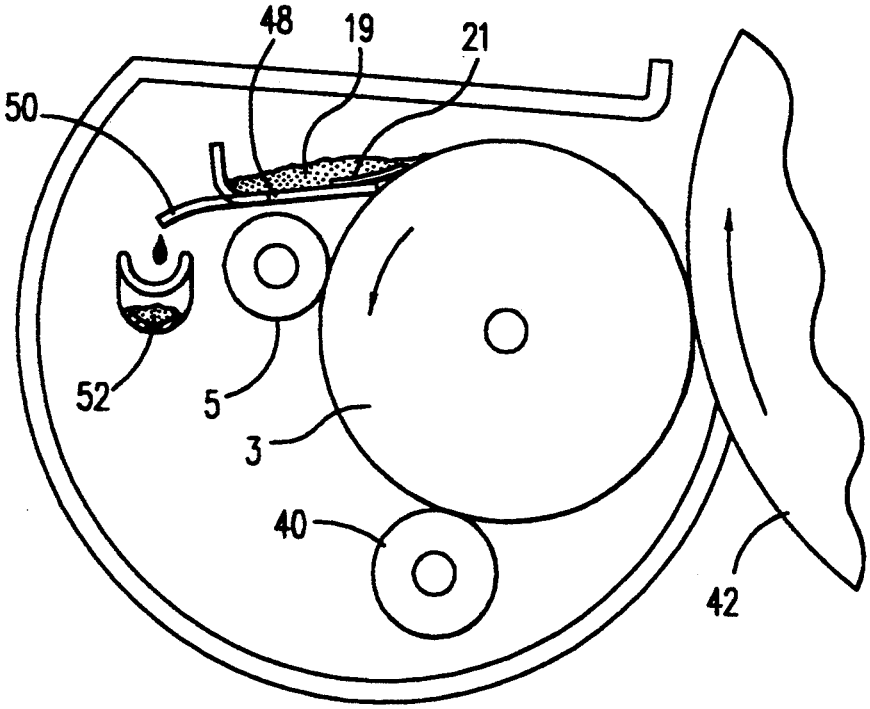
FIG. 4 is a side view illustrative of excess fluid collection.

As shown in FIG. 4, this embodiment has a squeegee roller 40 and an intermediate transfer roller 42, which are essentially conventional and also are shorter than the photoconductive drum by several millimeters on each end. The cleaning blade 21 extends entirely across the photoconductive drum 3, and in this embodiment has an upper surface which is directed slightly downward from the horizontal. It has end abutments 46 (FIG. 3) of a foam material, which serve to dam fluid 19 from escaping from the sides of photoconductor 3.

Blade 21 is contiguous with a receptacle trough 48, which leads to an exit conduit 50, which leads to a collection receptacle 52.

With respect to FIG. 4, photoconductor drum 3 turns counterclockwise, and charge roller 5, squeegee 40, and intermediate transfer roller 42 turn clockwise. Accordingly, as photoconductive drum 3 encounters cleaning blade 21, it is moving with gravity.

Oil 19 tends to remain at the ends of the photoconductor drum 3 because of the similar squeegee actions subsequent to the charge roll: at the developer (not shown in FIGS. 3 and 4) and intermediate roller 42 until photoconductor 3 delivers oil 19 to the cleaner blade 21. Cleaner blade 21 spans the length of the photoconductor drum 3. Foam end pieces 46, or similar device, at either end which serve to contain the excess oil 19, keeping it in front of cleaner blade 21 while preventing if from flowing around the ends of cleaner blade 21.

As oil 19 accumulates in front of the blade 21, it flows over the top edge of cleaner blade 21 (FIG. 4) and down into trough 48. As the excess oil 19 is collected in trough 48, it is conducted via gravity or vacuum suction through a tube or series of tubes 50, or equivalent means, to a waste collection area 52. The waste oil 19 is disposed of when a cartridge containing photoconductor 3 is replaced or by service personnel at some specified time, or by notification from the printer 1 through a float sensor or similar device, (not shown) that the waste collection tank is full.

As in the FIG. 1 embodiment, the embodiment of FIGS. 3 and 4 uses cleaning blade 21 as an incomplete squeegee device to insure that the charge roller 5 and photoconductive roller 3 pre-nip is loaded with oil 19 remaining on the photoconductive roller 3 by the development process. The excess oil is allowed to flow beyond the ends of charge roller 5 and onto the ends of the photoconductive drum 3 from which it is subsequently skived and collected by cleaner blade 21, and foam end pieces 46, and delivered to waste sump 48 and 52. Excess oil 19 is then disposed of in an appropriate way.

In summary, the addition of a dielectric fluid, as discussed above, to the pre-nip of our charge roll photoconductor system increases the charging efficiency of the system. This increased efficiency allows a lower charge roll voltage to be used to produce a desired photoconductor voltage. The charge enhancing mechanism may be employed with various charge roll configurations and material and dielectric fluids. A wide range of implementation clearly are possible.

What is claimed is:

1. An electrophotographic imaging apparatus comprising an endless photoconductive member for imaging, as endless contact charging member contacting the photoconductive member for charging said photoconductive member, said photoconductive member and said contact charging member rotating during imaging to form a nip as said members rotate into contact during imaging, a liquid development system to develop an electrostatic image on said photoconductive member by applying liquid toner, and means to apply an insulative liquid to said nip in sufficient amount to prevent dielectric breakdown in the region preceding said nip.

2. The imaging apparatus as in claim 1 in which said means to apply an insulative liquid comprises an applicator applying liquid to said photoconductor after it is cleaned.

3. The imaging apparatus as in claim 2 in which said charging member is pressed to said photoconductive member to squeegee said liquid from said photoconductor.

4. The imaging apparatus as in claim 1 in which said charging member is pressed to said photoconductive member to squeegee said liquid from said photoconductor.

5. The imaging apparatus as in claim 4 in which said charging member is shorter than said photoconductive member and also comprising liquid collection means located on at least the side or sides of said photoconductive member where said charging member does not contact said photoconductive member.

6. An electrophotographic imaging apparatus comprising an endless photoconductive member for imaging, an endless contact charging member contacting the photoconductive member for charging said photoconductive member, said photoconductive member and said contact charging member rotating during imaging to form a nip as said members rotate into contact during imaging, a liquid development system to develop an electrostatic image on said photoconductive member by applying liquid toner, and a cleaning station for said photoconductive member which incompletely cleans said photoconductive member to apply an insulative liquid to said nip.

7. The imaging apparatus as in claim 6 in which said charging member is pressed to said photoconductive member to squeegee said liquid from said photoconductor.

8. The imaging apparatus as in claim 7 in which said charging member is shorter than said photoconductive member and also comprising liquid collection means located on at least the side or sides of said photoconductive member where said charging member does not contact said photoconductive member.

9. The imaging apparatus as in claim 6 in which said charging member is shorter than said photoconductive member and also comprising liquid collection means located on at least the side or sides of said photoconductive member where said charging member does not contact said photoconductive member.

10. An electrophotographic imaging apparatus comprising an endless photoconductive member for imaging, an endless contact charging member contacting the photoconductive member for charging said photoconductive member, said photoconductive member and said contact charging member rotating during imaging to form a nip as said members rotate into contact during imaging, a liquid development system to develop an electrostatic image on said photoconductive member by applying liquid toner, and means to apply an insulative liquid to said nip, said charging member being shorter than said photoconductive member and also comprising liquid collection means located on at least the side or sides of said photoconductive member where said charging member does not contact said photoconductive member.

11. An electrophotographic imaging apparatus comprising an endless photoconductive member for imaging, an endless contact charging member contacting the photoconductive member for charging said photoconductive member, said photoconductive member and said contact charging member rotating during imaging to form a nip as said members rotate into contact during imaging, a liquid development system to develop an electrostatic image on said photoconductive member by applying liquid toner, and an applicator to apply an insulative liquid to said nip, said charging member being shorter than said photoconductive member and also comprising liquid collection means located on at least the side or sides of said photoconductive member where said charging member does not contact said photoconductive member.

12. The imaging apparatus as in claim 11 in which said charging member is pressed to said photoconductive member to squeegee said liquid from said photoconductor.

* * * * *